US006748662B2

(12) United States Patent
Yeh

(10) Patent No.: US 6,748,662 B2
(45) Date of Patent: Jun. 15, 2004

(54) HAIRDRESSING SCISSOR ASSEMBLY WITH ADJUSTABLE SPACING

(76) Inventor: Wen-Ya Yeh, No. 27, Kae-Shyuan Road, Tainan (TW)

( * ) Notice: Subject to any disclaimer, the term of this patent is extended or adjusted under 35 U.S.C. 154(b) by 6 days.

(21) Appl. No.: 10/280,868

(22) Filed: Oct. 25, 2002

(65) Prior Publication Data

US 2004/0078982 A1 Apr. 29, 2004

(51) Int. Cl.[7] ..... B26B 13/00

(52) U.S. Cl. ..... 30/226; 30/227; 30/254

(58) Field of Search ..... 206/518, 558, 206/512, 516, 576, 814; 403/286, 287, 293, 294, 227, 202; 30/254, 227, 197, 196, 226

(56) References Cited

U.S. PATENT DOCUMENTS

| | | | | |
|---|---|---|---|---|
| 184,914 | A | 11/1876 | Scripps | |
| 550,483 | A | 11/1895 | Carrier | |
| 596,213 | A * | 12/1897 | Loewenthal | 30/226 |
| D28,974 | S | 7/1898 | Girtanner | |
| 1,012,918 | A | 12/1911 | Roelants et al. | |
| D53,606 | S | 7/1919 | Rauh | |
| 1,662,373 | A | 12/1928 | Widdows | |
| 1,715,898 | A | 6/1929 | Carri | |
| 1,916,755 | A * | 7/1933 | Dowdell | 206/500 |
| 2,272,580 | A | 2/1942 | Phillips | |
| 2,456,858 | A | 12/1948 | Bolling | |
| D166,899 | S | 6/1952 | Ahlbin | |
| 2,840,905 | A | 7/1958 | Geiger | |
| D183,391 | S | 8/1958 | Kaplan | |
| 3,814,489 | A * | 6/1974 | Clark et al. | 428/357 |
| 3,934,340 | A | 1/1976 | Jones et al. | |
| D258,714 | S | 3/1981 | Backstrom | |
| 4,368,745 | A | 1/1983 | McGuffey | |
| D267,996 | S | 2/1983 | Kowalski | |
| D281,104 | S | 10/1985 | Davison | |
| 5,012,830 | A | 5/1991 | Vaccaro et al. | |
| 5,067,502 | A | 11/1991 | D'Orsi et al. | |
| 5,184,722 | A * | 2/1993 | Shin et al. | 206/449 |
| 5,349,971 | A | 9/1994 | Player | |
| 5,600,891 | A | 2/1997 | Orgal | |
| 5,813,417 | A | 9/1998 | Rudolph | |
| D406,998 | S | 3/1999 | Thomas | |
| 5,875,553 | A | 3/1999 | Geib, Jr. et al. | |
| 5,991,918 | A | 11/1999 | Choate | |
| 5,996,592 | A | 12/1999 | Choy | |
| 6,079,107 | A | 6/2000 | Horvath | |
| 6,135,123 | A | 10/2000 | Grassi et al. | |
| 6,192,590 | B1 | 2/2001 | Yeh | |
| 6,257,248 | B1 | 7/2001 | Yeh | |
| 6,385,851 | B2 | 5/2002 | Yeh | |
| 6,434,833 | B1 | 8/2002 | Yeh | |
| 6,601,304 | B2 * | 8/2003 | Yeh | 30/226 |
| 6,634,106 | B2 * | 10/2003 | Yeh | 30/226 |

FOREIGN PATENT DOCUMENTS

| | | |
|---|---|---|
| DE | 1918677 | 10/1970 |
| DE | 19963222 | 6/2001 |
| GB | 2337721 | 1/1999 |

* cited by examiner

*Primary Examiner*—Allan N. Shoap
*Assistant Examiner*—John Windmuller
(74) *Attorney, Agent, or Firm*—Alan D. Kamrath; Nikolai & Mersereau, P.A.

(57) ABSTRACT

A hairdressing scissor assembly includes at least two pair of scissors each having a first scissor element and a second scissor element pivoted to the first scissor element. Each of the first scissor element and the second scissor element includes a handle. A first engaging element is formed on a first side of a first connecting member and releasably engaged with a side of one of the handles of one of the pairs of scissors. A second engaging element is formed on a second side of the first connecting member and releasably engaged with the other side of one of said handles of the other pair of scissors. The first connecting member can be replaced by a second connecting member having a thickness different from that of the first connecting member, thereby allowing a change in a spacing between the pairs of scissors.

7 Claims, 13 Drawing Sheets

HAIRDRESSING SCISSOR ASSEMBLY WITH ADJUSTABLE SPACING

BACKGROUND OF THE INVENTION

1. Field of the Invention

The present invention relates to a hairdressing scissor assembly comprising at least two pairs of scissors, wherein a spacing between two pairs of scissors adjacent to each other can be easily adjusted according to the haircutting need.

2. Description of the Related Art

Different hairstyles suit different face contours. Therefore, a hairstylist would use several techniques including cutting, thinning, trimming, layering, etc. to create a hairstyle suitable for a customer based on the face contour and the characteristics of the customer. U.S. Pat. Nos. 6,192,590 and 6,434,833 disclose a hairdressing scissor assembly comprising a plurality of scissors that can be releasably connected together by connecting blocks. However, the spacing between two pairs of scissors adjacent to each other is fixed and thus allows limited cutting functions. Namely, a hairdressing scissor assembly having a spacing between two pairs of scissors adjacent to each other may be suitable to a customer with a specific face contour but not suitable to another customer with another face contour. Another factor that has to be considered is the length of hair. Thus, it would be time-consuming to the hairstylist to finish haircutting by a hairdressing scissor assembly having a fixed spacing between two pairs of scissors. U.S. Pat. No. 5,996,592 discloses a cutting tool having multiple scissors, wherein two pairs of scissors adjacent to each other are spaced apart by a spacing element. The spacing elements are of the same length or different length. However, since many elements are involved for securing all of the pairs of scissors together, adjustments of the spacing require troublesome detaching and reassembling of the elements.

SUMMARY OF THE INVENTION

An object of the present invention is to provide a hairdressing scissor assembly comprising at least two pairs of scissors, wherein a spacing between two pairs of scissors adjacent to each other can be easily adjusted according to a haircutting need.

In accordance with a first aspect of the invention, a hairdressing scissor assembly comprises:

at least two pairs of scissors each having a first scissor element and a second scissor element pivoted to said first scissor element, each of said first scissor element and said second scissor element including a blade and a handle having a first side and a second side;

a first connecting member having a first side and a second side, a first engaging means being formed on said first side of said first connecting member and releasably engaged with said second side of one of said handles of one of said at least two pairs of scissors, a second engaging means being formed on said second side of said first connecting member and releasably engaged with said first side of one of said handles of the other of said at least two pairs of scissors; and a second connecting member having a thickness different from that of said first connecting member, a third engaging means being formed on said first side of said second connecting member and releasably engaged with said second side of one of said handles of one of said at least two pairs of scissors, a fourth engaging means being formed on said second side of said second connecting member and releasably engaged with said first side of one of the handles of the other of said at least two pairs of scissors;

wherein one of said first connecting member and said second connecting member is selected to be connected between said one of said at least two pairs of scissors and the other of said at least two pairs of scissors, thereby allowing a change in a spacing between said at least two pairs of scissors.

In accordance with a second aspect of the invention, a hairdressing scissor assembly comprises:

two pairs of scissors each having a first scissor element and a second scissor element pivoted to said first scissor element, each of said first scissor element and said second scissor element including a blade and a handle having a first side and a second side;

two first connecting members each having a first side and a second side, a first engaging means being formed on said first side of each said first connecting member and releasably engaged with said second side of an associated one of said handles of one of said two pairs of scissors, a second engaging means being formed on said second side of each said first connecting member and releasably engaged with said first side of an associated one of said handles of the other pair of scissors; and two second connecting members each having a thickness different from that of said first connecting members, a third engaging means being formed on said first side of said second connecting member and releasably engaged with said second side of an associated one of said handles of one of said two pairs of scissors, a fourth engaging means being formed on said second side of said second connecting member and releasably engaged with said first side of an associated one of said handles of the other pair of scissors;

wherein said first connecting members and said second connecting members are selected to be connected between said one of said two pairs of scissors and the other pair of scissors, thereby allowing a change in a spacing between said two pairs of scissors.

In accordance with a third aspect of the invention, a hairdressing scissor assembly comprises:

two pairs of scissors each having a first scissor element and a second scissor element pivoted to said first scissor element, each of said first scissor element and said second scissor element including a blade and a handle having a first side and a second side, each said handle further having an opening extending from said first side of said handle through said second side of said handle;

at least three pairs of connecting members two pairs of which are selectively mounted in said openings of said handles, at least one of said at least three pairs of connecting members having a thickness different from that of the remaining pairs of connecting members, each said connecting member having a thickness greater than a depth of each said opening such that each said connecting member is exposed outside an associated one of said openings, each said connecting member having a first side and a second side, a first engaging means being formed on said first side of each said connecting member, a second engaging means being formed on said second side of each said connecting member, each said second engaging means of the connecting member mounted in said opening of one of said two pairs of scissors being releasably engaged with an associated one of said first engaging means of the connecting member mounted in said opening of the other pair of scissors;

wherein two pairs of said at least three pairs of connecting members are selected to connect said one of said two pairs of scissors to the other pair of scissors, thereby allowing a change in a spacing between said two pairs of scissors.

In accordance with a fourth aspect of the invention, a hairdressing scissor assembly comprises:

at least three pairs of scissors including at least a first pair of scissors, a second pair of scissors, and a third pair of scissors, each of said at least three pair of scissors having a first scissor element and a second scissor element pivoted to said first scissor element, each of said first scissor element and said second scissor element including a blade and a handle having a first side and a second side;

a first connecting member having a first side and a second side, a first engaging means being formed on said first side of said first connecting member and releasably engaged with said second side of one of said handles of said first pair of scissors, a second engaging means being formed on said second side of said first connecting member and releasably engaged with said first side of one of said handles of said second pair of scissors; and a second connecting member having a thickness different from that of said first connecting member, a third engaging means being formed on said first side of said second connecting member and releasably engaged with said second side of one of said handles of said second pair of scissors, a fourth engaging means being formed on said second side of said second connecting member and releasably engaged with said first side of one of the handles of said third pair of scissors.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
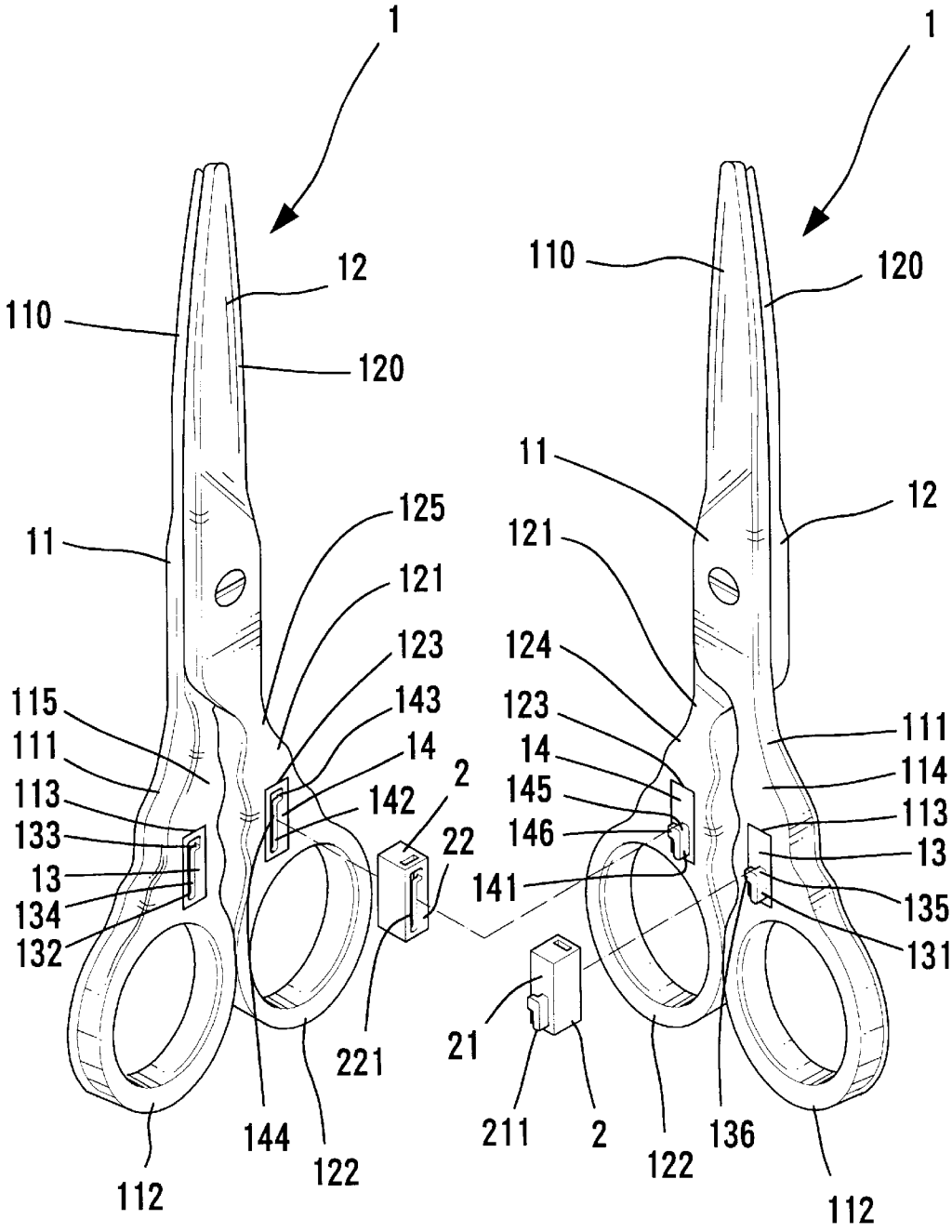
FIG. 1 is an exploded perspective view of an embodiment of a hairdressing scissor assembly in accordance with the present invention.

FIG. 1 illustrates a first embodiment of a hairdressing scissor assembly in accordance with the present invention. The hairdressing scissor assembly comprises at least two pairs of scissors 1 and two connecting members 2 connected between two pairs of scissors 1. The connecting members 2 in FIG. 2A can be replaced with connecting members 2' having a greater thickness, thereby changing the spacing between the pairs of scissors 1.

Referring to FIG. 1, each pair of scissors 1 includes a first scissor element 11 and a second scissor element 12 pivotally connected to the first scissor element 11. Each scissor element 11, 12 includes a blade 110, 120 at an end thereof and a handle 111, 121 at the other end thereof. Each handle 111, 121 includes a ring portion 112, 122 through which a thumb or an index finger of a user extends. Each handle 111, 121 further includes an opening 113, 123 extending from a first side 114, 124 of the handle 111, 121 through a second side 115, 125 of the handle 111, 121. An engaging member 13, 14 is received in the opening 113, 123 of each handle 111, 121 and includes an engaging groove 132, 142 in a first side thereof and an engaging rib 131, 141 on a second side thereof. Each engaging groove 132, 142 includes a vertical section 134, 144 and a horizontal section 133, 143. Each engaging rib 131, 141 is substantially L-shaped and includes a vertical section 135, 145 and a horizontal section 136, 146.

Figure 3:
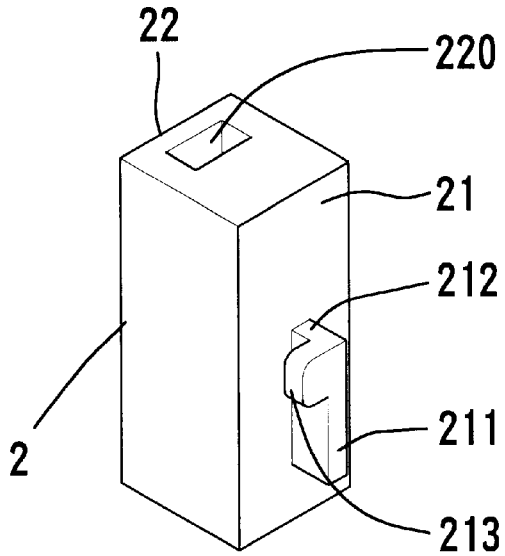
FIG. 3 is a perspective view of the connecting member in FIG. 1.
Figure 4:
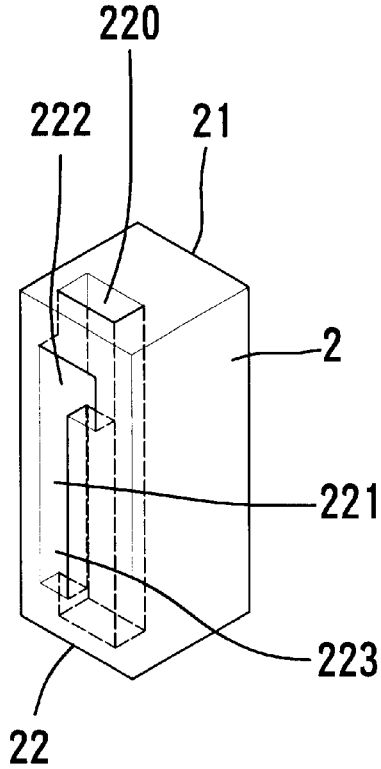
FIG. 4 is another perspective view of the connecting member in FIG. 3, showing the other side of the connecting member.

Referring to FIGS. 1, 3, and 4, each connecting member 2 includes an engaging rib 211 on a first side 21 thereof and an engaging groove 221 in a second side 22 thereof. The engaging rib 211 includes a vertical section 212 slidably received in the vertical section 134, 144 of the engaging groove 132, 142 of an associated engaging member 13, 14. The engaging rib 211 further includes a horizontal section 213 that can be passed through the horizontal section 133, 143 of the engaging groove 132 of an associated engaging member 13, 14. The engaging groove 221 of each connecting member 2 includes a vertical section 223 for slidingly receiving the vertical section 135, 235 of an associated engaging member 13, 14. The engaging groove 221 further includes a horizontal section 222 through which the horizontal section 136, 236 of the engaging rib 131, 141 of an associated engaging member 13, 14 is passable into a vertical channel 220 communicated with the engaging groove 221.

Figure 2A:
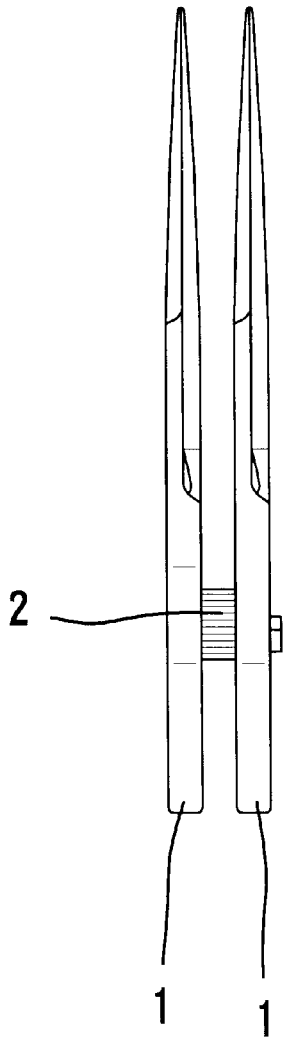
FIG. 2A is a side view of the hairdressing scissor assembly in FIG. 1.

In assembly, each connecting member 2 is engaged with the engaging member 13, 23 mounted in the opening 113, 123 of one pair of scissors 1 by means of passing the horizontal section 213 of the engaging rib 211 of the connecting member 2 through the horizontal section 133, 143 of the engaging groove 132 of an associated engaging member 13, 14 and then sliding the connecting member 2 downward to a predetermined position. Next, the other pair of scissors 1 is attached to the connecting members 2 by means of passing the horizontal section 136, 146 of the engaging rib 131 of each engaging member 13, 14 through the horizontal section 222 of the engaging groove 221 of each connecting member 2 and then sliding the other pair of scissors 1 downward. The resultant structure is shown in FIG. 2A. Detachment of the hairdressing scissor assembly can be easily accomplished in a reverse procedure.

Figure 2B:
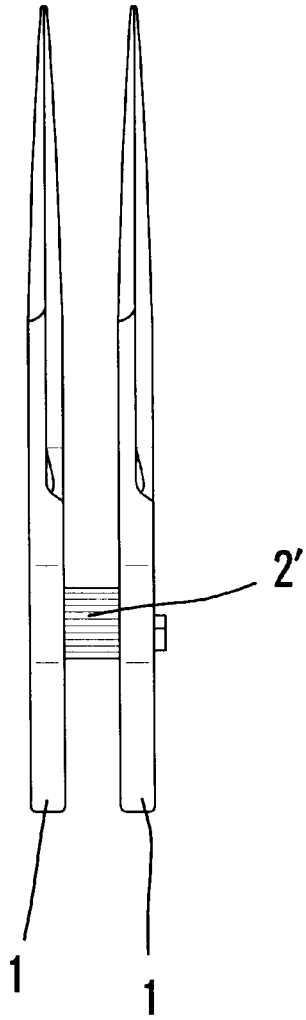
FIG. 2B is a side view similar to FIG. 2A, wherein a connecting member in FIG. 2A is replaced with another connecting member that is thicker.

As mentioned above, when adjustment of the spacing between the two pairs of scissors 1 is required, the user may detach the two pairs of scissors 1 and replace the connecting members 2 with thicker connecting members 2'. The connecting members 2' and the pairs of scissors 1 are assembled to provide a hairdressing scissor assembly having a larger spacing, as shown in FIG. 2B. Adjustment of the spacing depends on the face contour, the amount of hair to be cut, the cutting technique to be used, etc.

Figure 5:
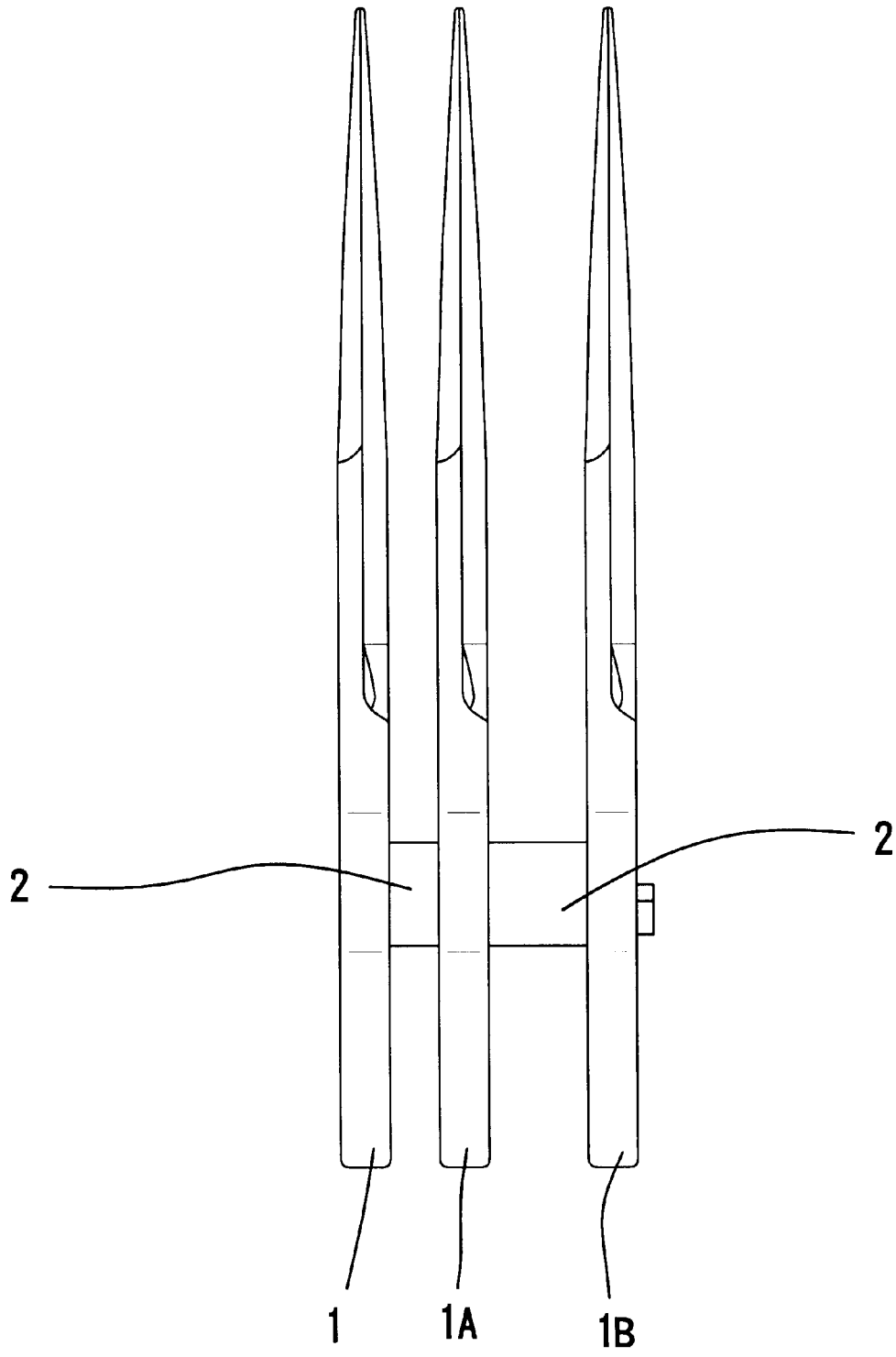
FIG. 5 is a side view of another embodiment of the hairdressing scissor assembly in accordance with the present invention.

FIG. 5 shows another embodiment of the hairdressing scissor assembly in accordance with the present invention. In this embodiment, the hairdressing scissor assembly includes a first pair of scissors 1, a second pair of scissors 1A that is connected to the first pair of scissors 1 by a connecting member 2, and a third pair of scissors 1B that is connected to the second pair of scissors 1A by another connecting member 2 that is wider. Thus, the spacing between the third pair of scissors 1B and the second pair of scissors 1A is larger than that between the second pair of scissors 1A and the first pair of scissors 1.

Figure 6:
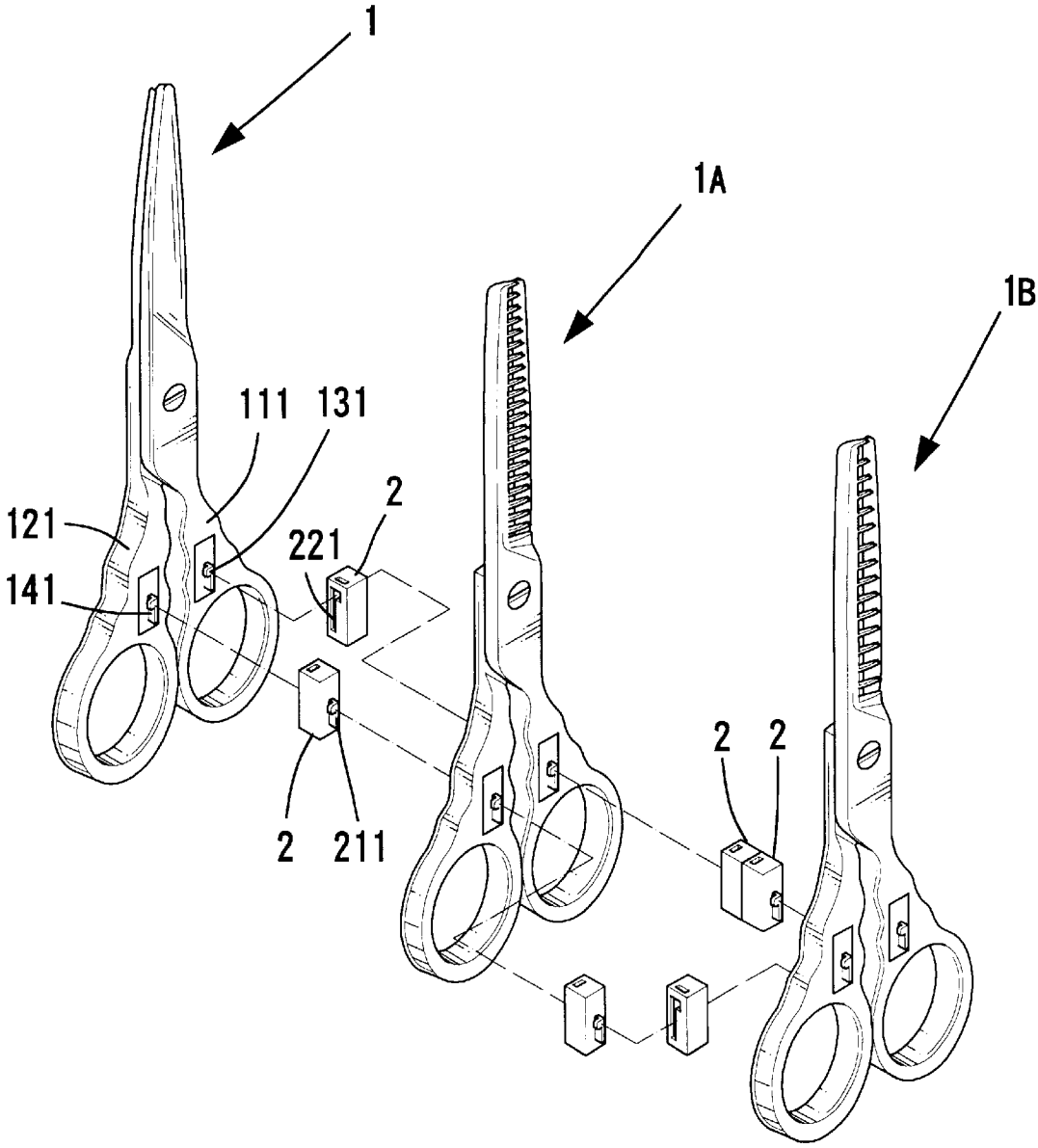
FIG. 6 is an exploded perspective view of a further embodiment of the hairdressing scissor assembly in accordance with the present invention.

The connecting member 2 and the engaging members 13 and 14 may be of identical or similar structure. The spacing between two pairs of scissors 1, 1A, 1B can be adjusted by means of varying the number of connecting members 2 connected between the two pairs of scissors 1 (see the connecting members 2 between the third pair of scissors 1B and the second pair of scissors 1A in FIG. 6). Further, one of the engaging members 13 and 14 of each pair of scissors 1, 1A, 1B and the associated one of the connecting members 2, 2' can be omitted.

Figure 7:
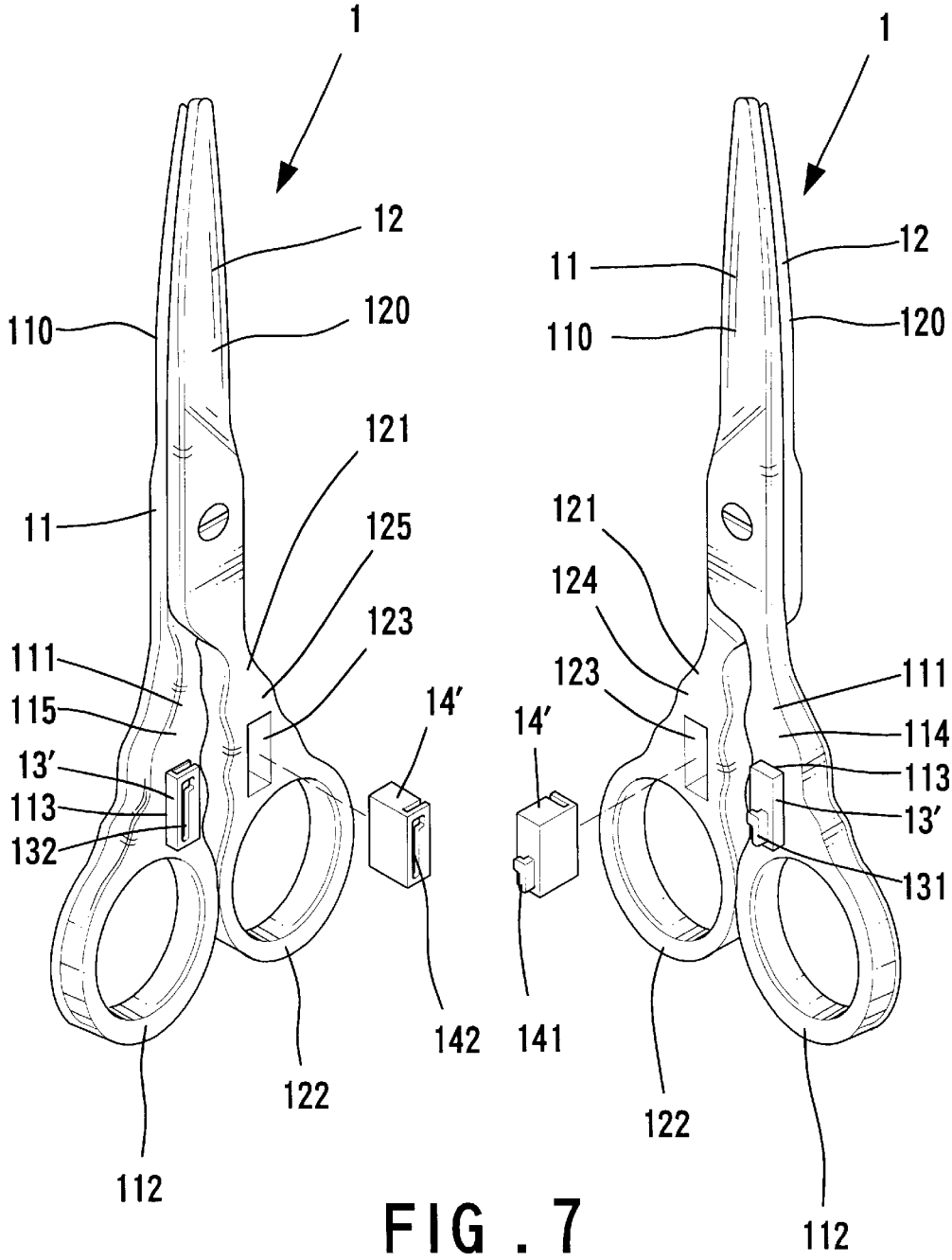
FIG. 7 is an exploded perspective view of still another embodiment of the hairdressing scissor assembly in accordance with the present invention.

FIG. 7 illustrates a further embodiment of the hairdressing scissor assembly in accordance with the present invention. In this embodiment, each engaging member (now designated by 13' and 14') is thicker than the depth of the opening 113, 123 of the handle 111, 121 of each pair of scissors 1. Thus, a portion of the engaging member 13', 14' is exposed between the two pairs of scissors 1 after the engaging members 13' and 14' are mounted in the openings 113 and 123. By means of removing the engaging member 13', 14' from the opening 113, 123 of the handle 111, 121 and replacing with another engaging member having a different thickness, the spacing between the two pairs of scissors 1 is changed.

Figure 8B:
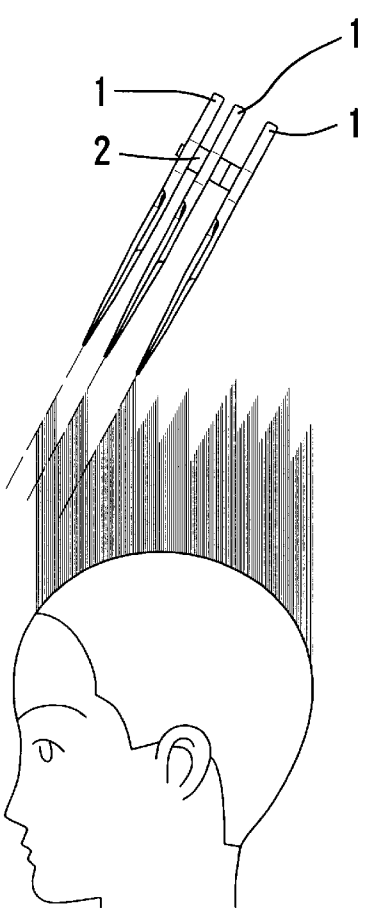
FIG. 8B is a schematic side view illustrating cutting of a distal portion of hair along an inclined angle by the hairdressing scissor assembly in accordance with the present invention.
Figure 8A:
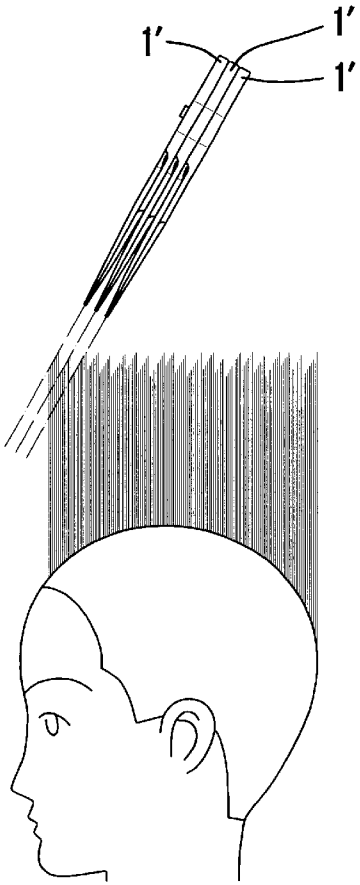
FIG. 8A PRIOR ART
FIG. 8A is a schematic side view illustrating cutting of a distal portion of hair along an inclined angle by a conventional hairdressing scissor assembly with a fixed spacing.

FIG. 8A is a schematic side view illustrating cutting of a distal portion of hair along an inclined angle by a conventional hairdressing scissor assembly with a fixed spacing. FIG. 8B is a schematic side view illustrating cutting of a distal portion of hair along an inclined angle by the hairdressing scissor assembly in accordance with the present invention. Since the spacing between two adjacent pairs of scissors 1' of the hairdressing scissor assembly in FIG. 8A is fixed (no spacing between the handles), it is difficult to provide a wide variety of styles for the hair. This is because the triangular portions cut from the distal portion of the hair are too uniform and too close to one another. By contrast, since the spacing between two adjacent pairs of scissors 1 of the hairdressing scissor assembly in FIG. 8B is adjustable, it is easy to provide a wide variety of styles for the hair. This is because the triangular portions cut from the distal portion of the hair make the resultant hairstyle more vivid.

Figure 9A:
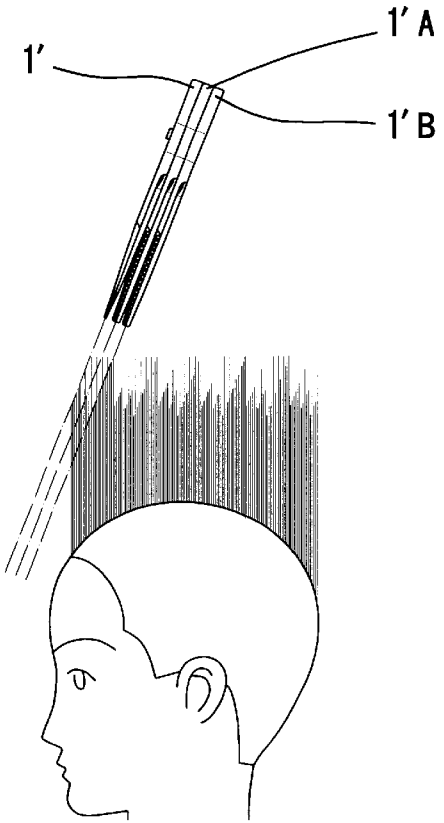
FIG. 9A PRIOR ART
FIG. 9A is a schematic side view illustrating cutting and thinning of a distal portion of hair along an inclined angle by a conventional hairdressing scissor assembly with a fixed spacing.
Figure 9B:
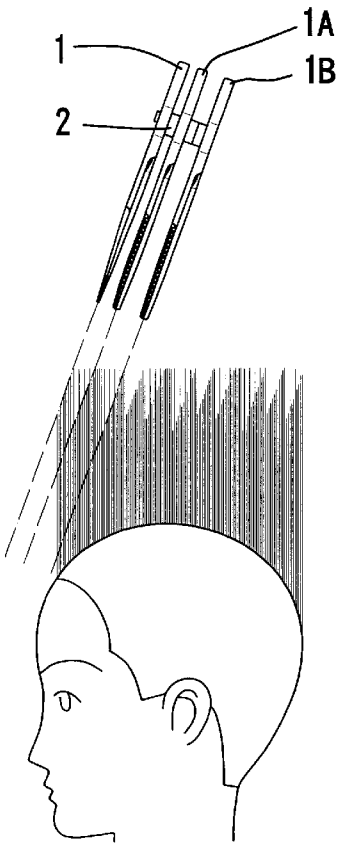
FIG. 9B is a schematic side view illustrating cutting and thinning of a distal portion of hair along an inclined angle by the hairdressing scissor assembly in accordance with the present invention.

FIG. 9A is a schematic side view illustrating cutting and thinning of a distal portion of hair along an inclined angle by a conventional hairdressing scissor assembly with a fixed spacing. FIG. 9B is a schematic side view illustrating cutting and thinning of hair along an inclined angle by the hairdressing scissor assembly in accordance with the present invention. Since the spacing between two adjacent pairs of scissors 1', 1'A and 1'B of the hairdressing scissor assembly in FIG. 9A is fixed (no spacing between the handles), the layering of the resultant hair is still too dense and thus fails to provide the desired style (layering effect). Also, it takes additional cutting procedures to obtain the desired hairstyle shown in FIG. 9B. By contrast, since the spacing between two adjacent pairs of scissors 1, 1A, and 1B of the hairdressing scissor assembly in FIG. 9B is adjustable, it is easy to obtain the desired hairstyle shown in FIG. 9B by a single cutting procedure.

Figure 10A:
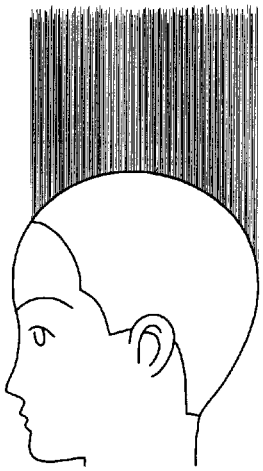
FIG. 10A is a schematic side view of hair before cutting.
Figure 10B:
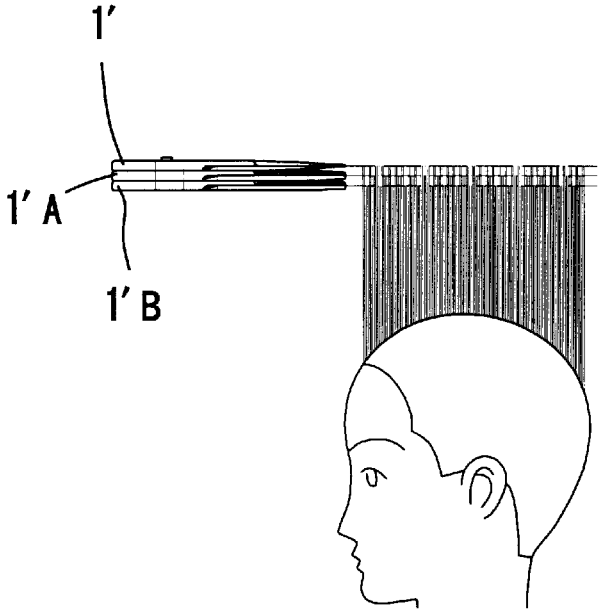
FIG. 10B PRIOR ART
FIG. 10B is a schematic side view illustrating trimming and thinning of a distal portion of hair by a conventional hairdressing scissor assembly with a fixed spacing.
Figure 10C:
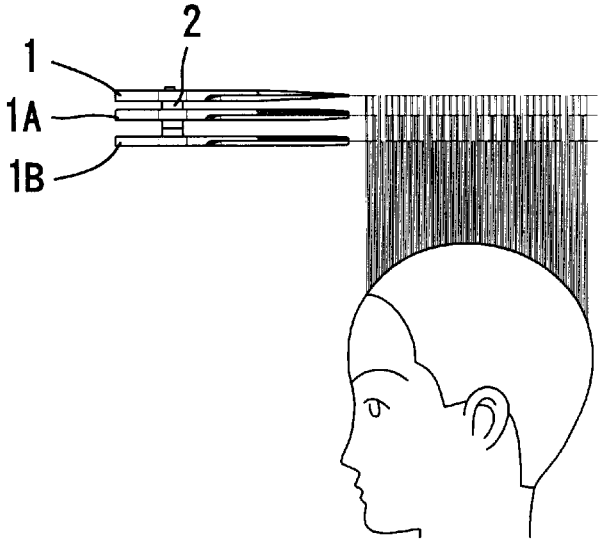
FIG. 10C is a schematic side view illustrating trimming and thinning of a distal portion of hair by the hairdressing scissor assembly in accordance with the present invention.

FIG. 10A is a schematic side view of hair before cutting. FIG. 10B is a schematic side view illustrating trimming and thinning of a distal portion of hair by a conventional hairdressing scissor assembly with a fixed spacing. FIG. 10C is a schematic side view illustrating trimming and thinning of a distal portion of hair by the hairdressing scissor assembly in accordance with the present invention. Since the spacing between two adjacent pairs of scissors 1', 1'A, 1'B of the hairdressing scissor assembly in FIG. 10B is fixed (no spacing between the handles), the layering of the resultant hair is still too dense and thus fails to provide the desired style (layering effect). By contrast, since the spacing between two adjacent pairs of scissors 1, 1A, 1B of the hairdressing scissor assembly in FIG. 10C is adjustable, it is easy to obtain the desired hairstyle in FIG. 10C by a single cutting procedure.

Figure 11B:
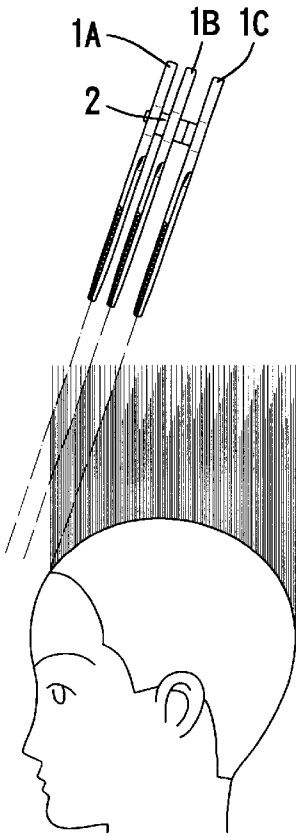
FIG. 11B is a schematic side view illustrating thinning of a distal portion of hair along an inclined angle by the hairdressing scissor assembly in accordance with the present invention.
Figure 11A:
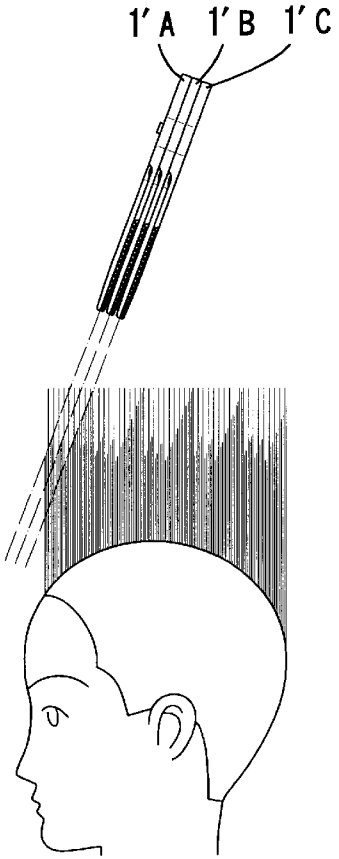
FIG. 11A PRIOR ART
FIG. 11A is a schematic side view illustrating thinning of a distal portion of hair along an inclined angle by a conventional hairdressing scissor assembly with a fixed spacing.

FIG. 11A is a schematic side view illustrating thinning of a distal portion of hair along an inclined angle by a conventional hairdressing scissor assembly with a fixed spacing. FIG. 11B is a schematic side view illustrating thinning of a distal portion of hair along an inclined angle by the hairdressing scissor assembly in accordance with the present invention. Since the spacing between two adjacent pairs of scissors 1', 1'A, 1'B of the hairdressing scissor assembly in FIG. 11A is fixed (no spacing between the handles), the hair is too thin and thus fails to provide the desired style (layering effect). By contrast, since the spacing between two adjacent pairs of scissors 1A 1B, 1C of the hairdressing scissor assembly in FIG. 11B is adjustable, it is easy to obtain the desired thicker hairstyle in FIG. 11B by a single cutting procedure.

Figure 12B:
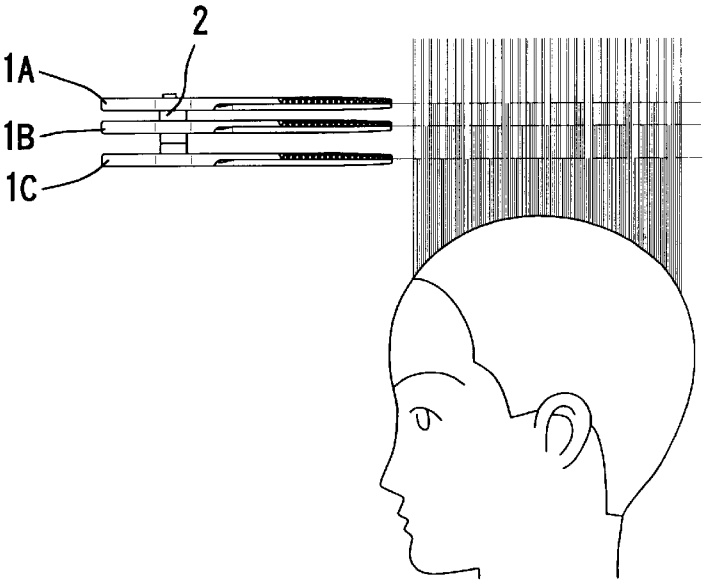
FIG. 12B is a schematic side view illustrating thinning of an intermediate portion of hair along an inclined angle by the hairdressing scissor assembly in accordance with the present invention.
Figure 12A:
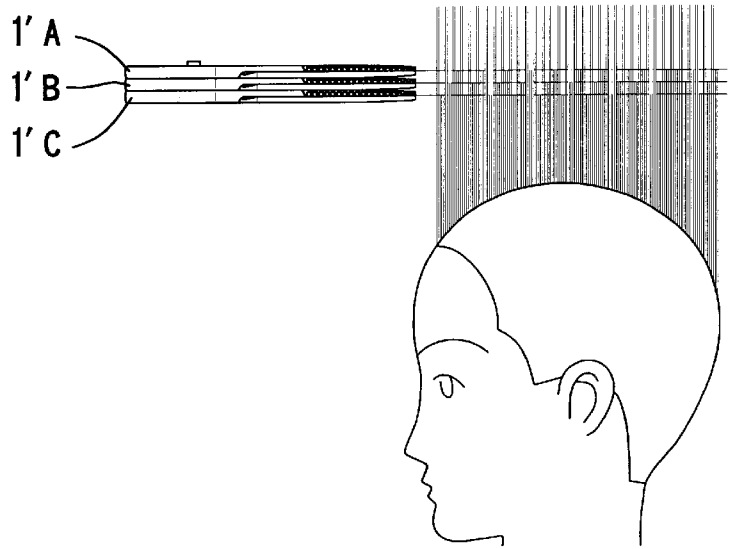
FIG. 12A PRIOR ART
FIG. 12A is a schematic side view illustrating thinning of an intermediate portion of hair along an inclined angle by a conventional hairdressing scissor assembly with a fixed spacing.

FIG. 12A is a schematic side view illustrating thinning of an intermediate portion of hair along an inclined angle by a conventional hairdressing scissor assembly with a fixed spacing. FIG. 12B is a schematic side view illustrating thinning of an intermediate portion of hair along an inclined angle by the hairdressing scissor assembly in accordance with the present invention. Since the spacing between two adjacent pairs of scissors 1', 1'A, 1'B of the hairdressing scissor assembly in FIG. 12A is fixed (no spacing between the handles), the layering of the intermediate portion of the resultant hair is still too dense and thus fails to provide the desired style (layering effect). By contrast, since the spacing between two adjacent pairs of scissors 1A, 1B, 1C of the hairdressing scissor assembly in FIG. 12B is adjustable, it is easy to obtain the desired thicker hairstyle in FIG. 12B by a single cutting procedure.

Figure 13:
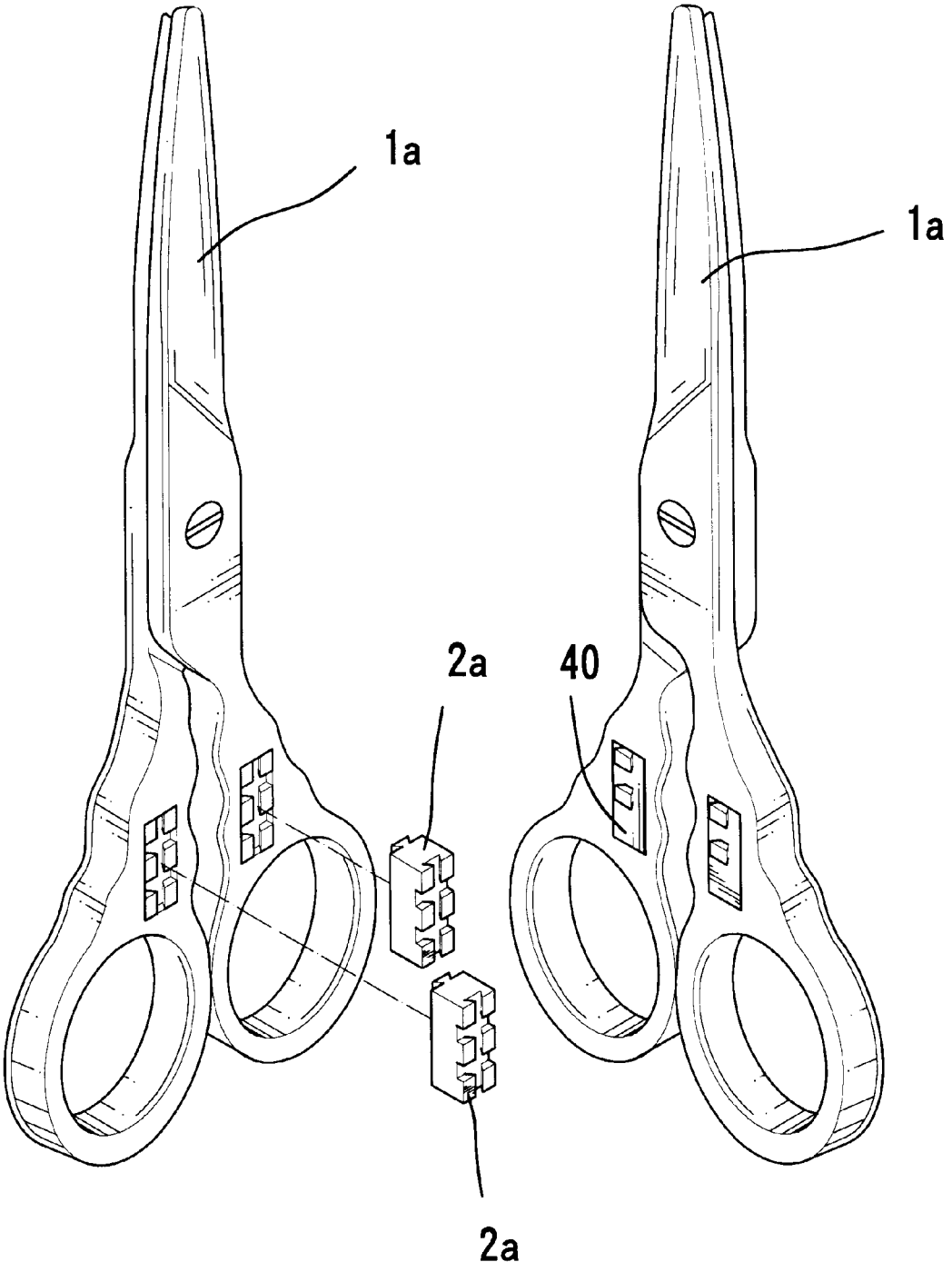
FIG. 13 is an exploded perspective view illustrating yet another embodiment of the hairdressing scissor assembly in accordance with the present invention.

FIG. 13 illustrates still another embodiment of the hairdressing scissor assembly in accordance with the present invention, wherein the connecting members 2*a* and the engaging members 40 are of a design different from that of the above embodiments. The connecting members 2*a* and the engaging members 40 are of an identical design. The adjustment of the spacing between two pairs of scissors 1*a* can be adjusted by either changing the thickness of the connecting members 2*a* or changing the number of the connecting members 2*a* see FIG. 6).

Figure 14:
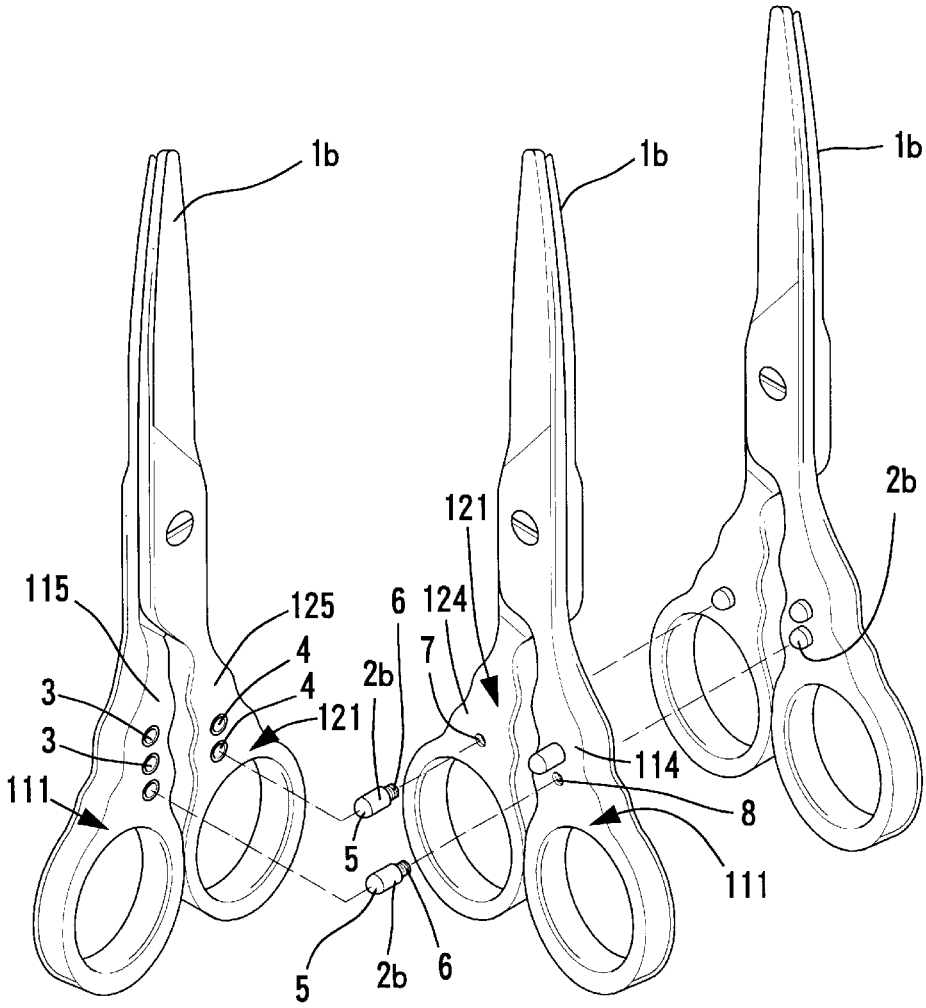
FIG. 14 is an exploded perspective view illustrating still another embodiment of the hairdressing scissor assembly in accordance with the present invention.

FIG. 14 illustrates yet another embodiment of the hairdressing scissor assembly in accordance with the present invention. In this embodiment, a handle 111 of each pair of scissors 1*b* includes two screw holes 8 in a first side 114, and the other handle 121 of each pair of scissors 1*b* includes a screw hole 7 in a first side 124 thereof. Further, the handle 111 of each pair of scissors 1*b* includes three holes 3 in a second side 115 thereof, and the other handle 121 of each pair of scissors 1*b* includes two holes 4 in a second side 125 thereof. A connecting member 2*b* in the form of a pin or the like includes a first end 5 releasably received in one of the holes 4 of one pair of scissors 1*b* and a second end 6 threadedly engaged in the screw hole 7 of another pair of scissors 1*b*. Further, two other connecting members 2*b* are provided and each includes a first end 5 releasably received in one of the holes 3 of the pair of scissors 1*b* and a second end 6 threadedly engaged in an associated screw hole 8 of another pair of scissors 1*b*. The adjustment of the spacing between two pairs of scissors 1*b* can be adjusted by either changing the length of the connecting members 2*b*.

Although the invention has been explained in relation to its preferred embodiment, it is to be understood that many other possible modifications and variations can be made without departing from the scope of the invention as hereinafter claimed.

What is claimed is:

1. A hairdressing scissor assembly comprising:

two pairs of scissors each having a first scissor element and a second scissor element pivoted to said first scissor element, each of said first scissor element and said second scissor element including a blade and a handle having a first side and a second side;

two first connecting members each having a first side and a second side, a first engaging means being formed on said first side of each said first connecting member and releasably engaged with said second side of an associated one of said handles of one of said two pairs of scissors, a second engaging means being formed on said second side of each said first connecting member and releasably engaged with said first side of an associated one of said handles of the other pair of scissors; and two second connecting members each having a thickness different from that of said first connecting members, a third engaging means being formed on said first side of said second connecting member and releasably engaged with said second side of an associated one of said handles of one of said two pairs of scissors, a fourth engaging means being formed on said second side of said second connecting member and releasably engaged with said first side of an associated one of said handles of the other pair of scissors;

wherein said first connecting members and said second connecting members are selected to be connected between said one of said two pairs of scissors and the other pair of scissors, thereby allowing a change in a spacing between said two pairs of scissors;

wherein said first engaging means is identical to said third engaging means;

wherein said second engaging means is identical to said fourth engaging means; and wherein each said handle includes an opening extending from said first side of said handle through said second side of said handle, an engaging member being received in each said opening and having a first side and a second side, a fifth engaging means being formed on said first side of said engaging member and identical to said first engaging means, a sixth engaging means being formed on said second side of said engaging member and identical to said second engaging means.

2. The hairdressing scissor assembly as claimed in claim 1, wherein said first engaging means is a substantially L-shaped engaging rib and wherein said second engaging means is a substantially L-shaped groove.

3. The hairdressing scissor assembly as claimed in claim 1, wherein each said engaging member has a thickness greater than a depth of each said opening.

4. A hairdressing scissor assembly comprising:

two pairs of scissors each having a first scissor element and a second scissor element pivoted to said first scissor element, each of said first scissor element and said second scissor element including a blade and a handle having a first side and a second side, each said handle further having an opening extending from said first side of said handle through said second side of said handle;

at least three pairs of connecting members two pairs of which are selectively mounted in said openings of said handles, at least one of said at least three pairs of connecting members having a thickness different from that of the remaining pairs of connecting members, each said connecting member having a thickness greater than a depth of each said opening such that each said connecting member is exposed outside an associated one of said openings, each said connecting member having a first side and a second side, a first engaging means being formed on said first side of each said connecting member, a second engaging means being formed on said second side of each said connecting member, each said second engaging means of the connecting member mounted in said opening of one of said two pairs of scissor being releasably engaged with an associated one of said first engaging means of the connecting member mounted in said opening of the other pair of scissors;

wherein two pairs of said at least three pairs of connecting members are selected to connect said one of said two pairs of scissors to the other pair of scissors, thereby allowing a change in a spacing between said two pairs of scissors.

5. A hairdressing scissor assembly comprising:

at least three pairs of scissors including at least a first pair of scissors, a second pair of scissors, and a third pair of scissors, each of said at least three pair of scissors having a first scissor element and a second scissor element pivoted to said first scissor element, each of said first scissor element and said second scissor element including a blade and a handle having a first side and a second side;

a first connecting member having a first side and a second side, a first engaging means being formed on said first side of said first connecting member and releasably engaged with said second side of one of said handles of said first pair of scissors, a second engaging means being formed on said second side of said first connecting member and releasably engaged with said first side of one of said handles of said second pair of scissors; and a second connecting member having a thickness different from that of said first connecting member, a third engaging means being formed on said first side of said second connecting member and releasably engaged with said second side of one of said handles of said second pair of scissors, a fourth engaging means being formed on said second side of said second connecting member and releasably engaged with said first side of one of the handles of said third pair of scissors;

wherein said first engaging means is identical to said third engaging means;

wherein said second engaging means is identical to said fourth engaging means; and wherein each said handle includes an opening extending from said first side of said handle through said second side of said handle, an engaging member being received in each said opening and having a first side and a second side, a fifth engaging means being formed on said first side of said engaging member and identical to said first engaging means, a sixth engaging means being formed on said second side of said engaging member and identical to said second engaging means.

6. The hairdressing scissor assembly as claimed in claim 5, wherein each said handle of said first pair of scissors and an associated one of said handles of said second pair of scissors include more than one said first connecting members attached therebetween.

7. The hairdressing scissor assembly as claimed in claim 5, each said handle of said second pair of scissors and an associated one of said handles of said third pair of scissors include more than one said second connecting members attached therebetween.

* * * * *